United States Patent [19]

Fischer et al.

[11] Patent Number: 4,743,318

[45] Date of Patent: May 10, 1988

[54] CARBURIZATION/OXIDATION RESISTANT WORKED ALLOY

[75] Inventors: John J. Fischer; Gaylord D. Smith, both of Huntington, W. Va.

[73] Assignee: Inco Alloys International, Inc., Huntington, W. Va.

[21] Appl. No.: 910,887

[22] Filed: Sep. 24, 1986

[51] Int. Cl.[4] ..... C22C 38/00; C22C 38/44

[52] U.S. Cl. ..... 148/442; 148/409; 148/327; 420/584; 420/585; 420/586; 138/DIG. 6

[58] Field of Search ..... 420/52, 53, 584, 585, 420/586; 148/909, 327, 442, 12.1, 12 R; 138/177, 134, DIG. 6, 143; 428/586

[56] References Cited

U.S. PATENT DOCUMENTS

| | | | |
|---|---|---|---|
| 587,492 | 11/1959 | Loveless | 420/52 |
| 3,690,873 | 9/1972 | Fontaine | 420/584 |
| 3,754,898 | 8/1973 | McGurty | 420/584 |
| 3,817,747 | 6/1974 | Schultz et al. | 420/584 |
| 3,912,552 | 10/1975 | Schultz et al. | 420/584 |
| 4,080,204 | 3/1978 | Panzera | 420/584 |
| 4,086,085 | 4/1978 | McGurty | 420/584 |
| 4,248,629 | 2/1981 | Pons et al. | 420/52 |
| 4,312,682 | 1/1982 | Herchenroeder | 420/443 |
| 4,385,934 | 5/1983 | McGurty | 420/584 |
| 4,388,125 | 6/1983 | Benn | 420/584 |
| 4,578,130 | 3/1986 | Korenko | 420/584 |

FOREIGN PATENT DOCUMENTS

| | | | |
|---|---|---|---|
| 1147574 | 4/1969 | United Kingdom | 420/584 |
| 1230396 | 4/1971 | United Kingdom | 420/584 |

OTHER PUBLICATIONS

J. J. Moran and J. W. Schultz, "The High Temperature Corrosion Resistance of Iron-Nickel-Chromium Alloy Containing Some Aluminum", Apr. 3, 1967.

A. Schnaas and H. J. Grabke, "High Temperature Corrosion and Creep of Ni-Cr-Fe Alloys in Carburizing and Oxidizing Environments", Nov. 5, 1978.

D. E. Hendrix and Malcolm W. Clark, P.E., "Contributing Factors to the Unusual Creep Growth of Furnace Tubing in Ethylene Pyrolysis Service", Paper No. 21, Corrosion 85, pp. 21/1-21/11—Mar. 25-29, 1985, Sheraton Hotel.

*Primary Examiner*—Deborah Yee

*Attorney, Agent, or Firm*—Raymond J. Kenny; Francis J. Mulligan, Jr.

[57] ABSTRACT

An iron-nickel-chromium-aluminum alloy containing about 30 to 40% nickel, about 15 to less than 19% chromium, about 2 to 4% aluminum, carbon in an amount of at least 0.05% and up to 0.2%, about 0.2 to 0.8% titanium, from 1.5 to 4% molybdenum, up to 0.1% boron, up to 0.5% zirconium, up to about 5% cobalt and the balance iron.

Alloy is characterized by (i) carburization resistance and (ii) stress-rupture strength which is desirable for ethylene pyrolysis tubing, (iii) highly oxidation resistant, (iv) cold workable such that mill product forms can be readily produced without deleterious cracking, (vi) ductile, (vii) structurally stable, i.e., will resist forming detrimental quantities of undesirable phases such as sigma, and (viii) weldable.

11 Claims, No Drawings

CARBURIZATION/OXIDATION RESISTANT WORKED ALLOY

FIELD OF INVENTION

The subject invention concerns iron-nickel-chromium-aluminum-molybdenum (Fe-Ni-Cr-Al-Mo) alloys and is particularly directed to Fe-Ni-Cr-Al alloys having a desired combination of properties, including excellent resistance to both carburization and oxidation attack, whereby they can be utilized in extremely corrosive operational environments such as encountered in cracking natural gas liquid feedstocks.

BACKGROUND OF INVENTION

Iron-nickel-chromium alloys, as is known, are extensively used under diverse service conditions requiring any number of different metallurgical properties. Such materials offer various degrees of corrosion resistance, ductility, stress-rupture strength, etc. One of the more demanding in-service applications involves the petrochemical industry wherein natural gas liquid feedstocks used in olefin pyrolysis are experienced. This environment is causative of rather severe degradation in respect of alloys currently used for radiant section tubes of pyrolysis furnaces. In an article co-authored by D. E. Hendrix and M. W. Clark entitled "Contributing Factors To the Unusual Creep Growth Of Furnace Tubing In Ethylene Pyrolysis Service and presented at the Mar. 25-29, 1985 International Corrosion Form, the writers described how currently used alloys HK-40 (Nominally 25% Cr, 20% Ni, Bal. Fe) and HP-40+1% Nb (nominally 25% Cr, 35% Ni, 1% Nb Bal. Fe) undergo premature failure due to carburization attack which, in turn, leads to excessive axial creep growth in respect of the pyrolysis heater tubing formed from such alloys. (Carburization is a phenomenon by which the alloy structure is environmentally degraded from the surface inward. As a consequence, the load bearing capacity of an alloy is adversely impacted as reflected by impaired strength, particularly stress-rupture and creep, and reduced ductility. Initial attack is usually along the grain boundaries and this tends to accelerate failure).

Apart from (i) carburization resistance and (ii) stress-rupture strength what is also desirable for ethylene pyrolysis tubing is an alloy which is (iii) highly oxidation resistant, (iv) both hot and (v) cold workable such that mill product forms can be readily produced without deleterious cracking, (vi) ductile, (vii) structurally stable, i.e., will resist forming detrimental quantities of undesirable phases such as sigma, and (viii) weldable. For an alloy to be highly carburization and creep resistant, for example, but not workable is self-defeating since an alloy in wrought form could not be produced. Conversely, to be workable without high resistance to carburizing attack would not be a panacea.

SUMMARY OF INVENTION

We have found that certain iron-nickel-chromium-aluminum-molybdenum alloys of controlled and special composition afford an exceptional combination of resistance to carburization and oxidative attack while concomitantly manifesting good creep rupture strength, workability, ductility, etc. And the combination of properties in turn renders the alloys not only suitable for the production of pyrolysis radiant tubing but also for use in a host of applications, including furnace belts, materials of construction in heat treating and sintering equipment, components for high temperature hardware used in the chemical, thermal process and petrochemical industries, including retorts, slaggers, kilns, recuperators, heat exchangers, etc. We have also determined that a key characteristic of the alloy is its ability to form a protective oxide scale or film which virtually precludes or markedly inhibits carbon absorption during service involving natural gas liquid feedstocks.

DESCRIPTION OF THE INVENTION

Generally speaking and in accordance herewith, the instant invention contemplates an iron-nickel-chromium-aluminum alloy containing about 30 to 40% nickel, about 15 to less than 19% chromium, about 2 to 4% aluminum, carbon in an amount of at least 0.05% and up to 0.2%, about 0.2 to 0.8% titanium, from 1.5 to 4% molybdenum, up to 0.1% boron, up to 0.5% zirconium, up to about 5% cobalt and the balance essentially iron. As contemplated herein, the expressions "balance" and "balance essentially" in referring to the iron content do not preclude the presence of other elements often present as incidental constituents, including deoxidizing and cleansing elements, and usual impurities associated therewith in amounts which do not adversely affect the basic characteristics of the alloy. Manganese, silicon, calcium and cerium are examples of such constituents.

In carrying the invention into practice care must be exercised in terms of compositional control. For example, it has been found that the nickel content must be at least 30% and preferably 32% or more to avoid cracking upon hot working. At a level of 25% considerable hot cracking has been experienced upon rolling at 2000° F. (1093° C.). Some edge cracking occurred at the 30% nickel level. On the other hand, no appreciable benefit has been obtained with nickel contents of, say, 40 to 45%. Stress rupture life is not improved. Thus, a nickel range of 32 to 38%, particularly 33 to 37% has been found most satisfactory.

Chromium is required for corrosion resistance. However, excessive chromium can cause a loss in stress-rupture strength and lends to the formation of the embrittling sigma phase. While up to 21 or 22% chromium can be present for various corrosive environments or where optimum strength is not necessary, it is preferred that it not exceed 19%. We might add that a level of 15 to 21% has shown to result in a minimum of carburization attack although the over all effect might not be greatly significant in this regard. Oxidation resistance is not appreciably enhanced with a chromium content of, say, 20% versus 16% as will be shown infra. Accordingly, a chromium range of 16 to 18.5%, is deemed quite advantageous especially when the benefit of the aluminum content is considered.

Aluminum contributes to both carburization and oxidation resistance at elevated temperature, particularly at or above 1800°-1900° F. 922°-1038° C.) Tests conducted at circa 2000° F. (1093° C.) reflect a dramatic resistance to both forms of attack at the 3.5 to 4% level. Aluminum percentages over 4% do not offer any appreciable benefit and, indeed, impair stress-rupture strength. Upon prolonged exposure at elevated service conditions which is a sine qua non for the invention alloy, gamma prime can form as a result of aluminum content and this in turn can be causative of a loss in ductility.

With regard to the elements molybdenum, carbon and titanium molybdenum improves stress-rupture strength without subverting carburization/oxidation resistance. It also unexpectedly promotes adherence of the oxide film and enhances aqueous corrosion resistance generally. Given cost, this constituent need not exceed 4%, a range of 2.5 to 3.5% being quite satisfactory. Concerning carbon, low levels lend to lower stress-rupture properties. The carbon can be extended up to about 0.3% at the risk of a loss in stress-rupture strength. Thus, it is preferred that the carbon content be from 0.07 to 0.15% with a range of 0.08 to 0.12% being deemed beneficial. Titanium is important for workability and strength. However, it can detract from stress-rupture life if present at, say, must above the 1% level. On the other hand, if omitted this characteristic suffers. High titanium also tends to reduce oxidation resistance. It should not exceed about 1%, and a range of 0.3 to 0.75% is preferred.

Apart from the foregoing it is advantageous for stress-rupture strength that at least one of boron and zirconium be present, a boron range of 0.003 to 0.02% and a zirconium range of 0.05 to 0.25% being preferred.

In respect of other constituents, cobalt enhances strength, a range of 1 to 5% being satisfactory in most instances. Niobium is not essential and while a minor amount might be tolerated, a 1% level has been found to detract from cold fabricability. Silicon and manganese can be present up to 1% each although manganese above 0.5 or 0.6% can impair oxidation resistance. Yttrium is not necessary and is considered to impair weldability. Any retained cerium should be less than 0.1%. Low level of cerium (0.004%) are beneficial to room temperature ductility even after exposure to 2300° F. whereas high percentages such as 0.06% result in a ductility loss. Lanthanum at, say, the 0.05% level also causes a loss in ductility after exposure at 2300° F. Nitrogen can impair stress-rupture life in the absence of grain size control. In this regard, greater than about 0.025% nitrogen makes grain growth to about ASTM 2 difficult to achieve at conventional annealing temperatures, i.e., 2150° F. or less.

In addition to the above, chemistry and heat treatment are preferably controlled such that the alloys are characterized by an average grain size not finer than about ASTM 2, i.e., the grain size should be from ASTM 00 to ASTM 2. Given this, the alloys should be solution-annealed at a temperature below 2400° F. (1316° F. (1316° C.) and within a range of 2100° F. (1150° C.) to 2300° F. (1260°C.), preferably 2150° F. (1180° C.) to 2300° F. (1260° C.). By controlling grain size higher stress-rupture and creep strength are obtained.

The following information and data are given as illustrative of the invention.

The compositions given in Table I were prepared as experimental 50 lb. heats or less using vacuum melting. The heats were forged and hot rolled to ½ inch-diameter bar and plate and then annealed for four hours at 2250° F. Stress-rupture, tensile, carburization, oxidation and ductility retention tests were conducted, the test conditions and data being given in Tables II through IX. The carburization test comprised exposing specimens in a gaseous atmosphere of (a) 1% methane and hydrogen or (b) 22% methane −21% $CO_2$—$H_2$ or (c) $H_2$—12 $CH_4$—10 $H_2O$ to simulate various industrial service environments. The oxidation test comprised subjecting specimens to air +5 $H_2O$ for approximately 500 hour periods. All specimens were examined for the occurence of cracking. Two commercial alloys, CA1 and CA2, well known for their resistance to oxidation are included in Tables I and IV for comparison purposes, compositions denoted by numerals are within the invention.

Cold rolling trials were conducted on selected compositions to determine if essentially crack-free plate and sheet could be produced.

Referring to Table II the effect of various constituents on stress-rupture life is given. Molybdenum, as indicated previously, imparts stress-rupture strenth. As can be seen from Table II, Alloys 5 and 16 (containing 3% Mo) have superior strength at 2000° F. compared to Alloy A which contains 0.15% molybdenum and Alloy B (1.03% Mo). High values of molybdenum (Alloys E and F) showed poor ductility, particularly after exposure at 1400° F.

Carbon and titanium also enhance stress-rupture properties provided they are present in proper percentages. For example, 0.03% carbon resulted in poor stress-rupture strength and percentages at about 0.3% reflected a downturn in this property, as did about 1% titanium. It is deemed beneficial that the carbon be from 0.07% to not more than about 0.2% and advantageously from 0.08 to 0.12 or 0.15%, the titanium being from 0.3 to 0.7%.

With regard to chromium, levels of 20% (Alloy 11) and 22% (Alloy 14) were weaker than those alloys of, say, 18 or 18.5% and lower (Alloy 9 and 10). Moreover, a chromium range 16 to 19% did not result in significant impairment in either oxidation or carburization strength (Tables III and IV).

While high aluminum impairs stress rupture strength it does, however, markedly improve resistance to both oxidation and carburization (Table V). Accordingly, a range of 2.5% to 3.5% aluminum is deemed most advantageous.

The presence of boron and zirconium (Alloy 1) will provide an improvement in stress-rupture properties compared to a similar composition (Alloy 2) but essentially free of boron and zirconium.

Cobalt contributes to strength as reflected by Alloys 5 and 9, Table II. It also appears to improve cold workability without appreciably detracting from oxidation and carburization resistance.

In determining alloy stability the alloys set forth in Table IX were exposed for up to 500 hours at 1400° F. and then tension tested at room temperature. The ductility prior to and after the high temperature exposure were compared and the results are given in Table IX. These results show that when the cobalt plus molybdenum content exceeds about 7%, the alloy suffers a significant loss of ductility after exposure at 1400° F. In general, elongation values of greater than about 10% would be acceptable for most applications, while lower values could lead to premature failure of components. An exception to the requirement of %Co+%Mo=7%, or less, is Alloy No. 8 which only contains about 2% aluminum. Low levels of aluminum aid retention of ductility, but decrease oxidation and carburization resistance.

Apart from the foregoing, autogenous, tungsten inert gas welds were prepared to determine cracking tendencies. This was essentially a bead-on-plate screening test and no cracking was found.

The alloys described herein can be prepared by techniques other than vacuum processing. Air melting, for example, can be employed but properties may not be as good. Conventional powder metallurgy processing can also be utilized.

Although the present invention has been described in conjuntion with preferred embodiments, it is to be understood that modifications and variations may be resorted to without departing from the spirit and scope of the invention, as those skilled in the art will readily understand. Such modifications and variations are considered to be within the purview and scope of the invention and appended claims.

TABLE I

| Alloy No. | CHEMICAL COMPOSITION Fe | Ni | Cr | Al | Co | Mo | Ti | C | Other |
|---|---|---|---|---|---|---|---|---|---|
| A | 41.93 | 35.17 | 18.03 | 3.46 | 0.36 | 0.15 | 0.02 | 0.07 | .019 B, .16 Zr |
| B | 39.62 | 35.21 | 17.95 | 3.53 | 1.96 | 1.03 | 0.02 | 0.07 | .018 B, .16 Zr |
| 1 | 35.83 | 34.97 | 18.24 | 3.28 | 4.74 | 2.09 | 0.54 | 0.31 | .017 B, .10 Zr, .09 Mn, .05 Si |
| 2 | 35.62 | 35.13 | 18.04 | 3.35 | 4.98 | 2.04 | 0.54 | 0.30 | .002 B, .08 Mn, .073 Si, .0025 Zr |
| 3 | 37.69 | 35.13 | 18.04 | 3.23 | 4.99 | 0.07 | 0.54 | 0.31 | .079 Mn, .089 Si |
| 4 | 35.91 | 34.89 | 18.17 | 3.37 | 5.00 | 2.03 | 0.53 | 0.10 | .078 Mn, .068 Si |
| 5 | 40.11 | 35.50 | 16.94 | 3.67 | 0.16 | 3.00 | 0.55 | 0.12 | .010 B, .002 Zr, .17 Mn, .10 Si |
| 6 | 39.92 | 32.70 | 19.40 | 4.30 | N.A. | 3.10 | 0.53 | 0.05 | .015 N |
| C | 35.63 | 35.56 | 17.55 | 3.43 | 5.01 | 2.09 | N.A. | 0.08 | .014 B, .05 Hf |
| 7 | 31.48 | 35.67 | 20.01 | 3.94 | 5.05 | 3.04 | 0.52 | 0.15 | .14 Mn, .01 Si |
| 8 | 33.91 | 35.53 | 20.02 | 2.09 | 5.00 | 3.10 | 0.54 | 0.08 | .14 Mn, .005 Si |
| D | 35.67 | 35.26 | 18.24 | 3.34 | 4.33 | 2.26 | N.A. | 0.09 | .015 B, .28 Zr |
| 9 | 36.46 | 35.54 | 17.59 | 3.49 | 3.11 | 2.96 | 0.56 | 0.12 | .004 B, .084 Zr, .20 Mn, .1 Si |
| 10 | 36.81 | 35.57 | 16.77 | 3.58 | 3.07 | 3.11 | 1.03 | 0.12 | .004 B, .075 Zr, .17 Mn, .09 Si |
| 11 | 36.34 | 32.96 | 20.22 | 3.38 | 2.83 | 2.79 | 0.51 | 0.12 | .016 B, .082 Zr, .13 Mn, .073 Si |
| 12 | 36.81 | 35.47 | 16.63 | 3.62 | 2.09 | 2.13 | 1.01 | 0.12 | .012 B, .084 Zr, 18 Mn, .11 Si |
| 13 | 33.37 | 36.97 | 18.97 | 3.57 | 2.95 | 2.94 | 0.53 | 0.09 | .014 B, .085 Zr, .075 Mn, .084 Si |
| 14 | 35.06 | 34.83 | 21.72 | 3.61 | 0.30 | 2.97 | 0.54 | 0.12 | .016 B, .082 Zr, .12 Mn, .069 Si |
| E | 30.08 | 36.48 | 13.73 | 4.16 | 7.10 | 7.41 | 0.75 | 0.07 | .14 Mn, .004 Si |
| F | 28.59 | 36.23 | 20.27 | 4.04 | 5.08 | 5.03 | 0.54 | 0.08 | .14 Mn, .01 Si |
| G | 34.81 | 35.51 | 20.05 | 3.83 | 4.94 | N.A. | 0.55 | 0.16 | .15 Mn, .014 Si |
| 15 | 31.50 | 35.53 | 20.10 | 3.95 | 5.15 | 3.02 | 0.53 | 0.09 | .14 Mn, .01 Si |
| 16 | 36.56 | 35.30 | 19.98 | 3.58 | 0.20 | 3.00 | 0.54 | 0.11 | .016 B, .088 Zr, .12 Mn, 073 Si |
| CA1 | 3 max. | 20–24 | 20–24 | — | Bal* | — | — | .05–.15 | 13–16 W, 1.25 Mn max., .2–.5 Si |
| CA2 | 39.5 min | 30–35 | 19–23 | .15–.6 | — | — | .15–.6 | .10 max | 1.5 Mn max, 1.0 Si max .75 Cu max |

N.A. = Not Added
*Bal = balance plus .03–.15 La
CA1 = commercial alloy #1
CA2 = commercial alloy #2

TABLE II

| Alloy No. | STRESS RUPTURE PROPERTIES 1800° F./4.5 KSI, Life (hrs.) | 2000° F./2.5 KSI, Life (hrs.) |
|---|---|---|
| Effect of Boron & Zirconium | | |
| 1 (B and Zr) | 31.5 | 22.8 |
| 2 (LOW B and Zr) | 16.3 | 13.5 |
| Effect of Molybdenum | | |
| A (0.15% Mo) | — | 5.6 |
| B (1.03% Mo) | — | 6.1 |
| 5 (3% Mo) | — | 29.1 |
| 16 (3% Mo) | — | 19.5 |
| Effect of Carbon | | |
| C (.08% C) | — | 11.4 |
| 4 (.10% C) | 25.7 | 18.3 |
| 2 (.30% C) | 16.3 | 13.5 |
| Effect of Aluminum | | |
| 15 (3.95% Al) | 21.0 | 12.0 |
| 7 (3.94% Al) | 38.6 | 16.2 |
| 8 (2.09% Al) | 43.1 | 16.7 |
| Effect of Titanium | | |
| D (0% Ti) | — | 9.4 |
| 9 (.56% Ti) | 62.9 | 33.9 |
| 10 (1.03% Ti) | 53.2 | 22.2 |
| Effect of Chromium | | |
| 9 (17.59% Cr) | 62.9 | 32.9 |
| 10 (16.77% Cr) | 53.2 | 22.8 |
| 11 (20.22% Cr) | 28.0 | 29.8 |
| 14 (21.72% Cr) | 16.0 | 16.1 |
| Effect of Cobalt | | |
| 5 (.16 Co) | 43.8 | 29.1 |

TABLE II-continued

| Alloy No. | STRESS RUPTURE PROPERTIES 1800° F./4.5 KSI, Life (hrs.) | 2000° F./2.5 KSI, Life (hrs.) |
|---|---|---|
| 9 (3.11 Co) | 62.9 | 32.9 |

TABLE III

Effect of Chromium on the Carburization Resistance

| Alloy No. | Alloying Elements | Carburization* (mg/cm$^2$) |
|---|---|---|
| 12 | 16.63% Cr, 2.09% Co. | 0.15 |
| 10 | 16.77% Cr, 3.07% Co | 0.13 |
| 13 | 18.97% Cr, 2.95% Co | 0.09 |
| 11 | 20.22% Cr, 2.83% Co | 0.09 |
| 14 | 21.72% Cr, 0.30% Co | 0.11 |

Note:
Exposed 168 hr. at 1830° F. to $H_2$ - 1% $CH_4$ atmosphere

TABLE IV

Effect of Chromium on Oxidation and Carburization

| Alloy No. | Oxidation (mg/cm$^2$) 1830° F. | 2010° F. | Carburization (mg/cm$^2$) 1830° F. - 240 Hr. |
|---|---|---|---|
| E (13.73% Cr) | 0.16 | 1.12 | 0.36 |
| F (20.27% Cr) | 0.48 | 0.98 | 0.38 |
| Commercial Alloy 1 | | −45.8 | — |
| Commercial Alloy 2 | | −144.2 | 0.70 |

NOTE:
Oxidation done in air +5% $H_2O$ for 504 hr.
Carburization done in $H_2$ - 22% $CH_4$ - 21% $CO_2$

TABLE V

| Effect of Aluminum on Oxidation and Carburization (mg/cm²) | | | | |
|---|---|---|---|---|
| | Oxidation (504 hrs)* | | Carburization - 240 hr./1830° F. | |
| Alloy No. | 1830° F. | 2010° F. | $H_2$ - 1% $Ch_4$ | $H_2$ - 22 $CH_4$ - 21 $CO_2$ |
| 8 (2.1% Al) | 0.62 | −82.3 | 2.9 | 3.4 |
| 7 (3.94% Al) | 0.47 | 1.19 | 0.09 | 0.4 |

*In air +5% $H_2O$

TABLE VI

| Effect of Titanium on Oxidation and Carburization (mg/cm²) | | | |
|---|---|---|---|
| | Oxidation* | | |
| Alloy No. | 1830° F. - 1080 hr | 2030° F. - 182 hr | Carburization 2010° F. - 984 hr. |
| D (0% Ti) | 0.24 | — | — |
| 5 (0.55% Ti) | 0.57 | 0.04 | 3.1 |
| 9 (0.56% Ti) | −2.50 | −83 | 4.7 |
| 12 (1.0% Ti) | −30.2 | −86.8 | 3.0 |
| 10 (1.03% Ti) | 0.71 | −260 | 2.7 |

*In air +5% $H_2O$
**In $H_2$ - 12% $CH_4$ - 10% $H_2O$

TABLE VII

| Effect of Molybdenum on the Oxidation and Carburization (mg/cm²) | | | |
|---|---|---|---|
| | Air +5% $H_2O$ - 504 Hr | | Carburization* |
| Alloy No. | 1830° F. | 2010° F. | 1830° F. for 240 hrs. |
| G (0% Mo) | 0.54 | 1.28 | .34 |
| 15 (3.02% Mo) | 0.44 | 1.13 | .41 |
| 7 (3.04% Mo) | 0.47 | 1.19 | .36 |

*In $H_2$ - 22% $CH_4$ - 21% $CO_2$

TABLE VIII

| Effect of Cobalt on the Oxidation and Carburization (mg/cm²) | | | |
|---|---|---|---|
| Alloy No. | 1830° F. | Time (Hrs.) | Carburization 2010° F. - 984 hr. |
| 16 (0% Co) | 0.018 | 168 | — |
| 5 (0.16% Co) | 0.57 | 1080 | 3.07 |
| 11 (2.8% Co) | 0.09 | 168 | — |
| 9 (3.1% Co) | −2.5 | 1080 | 4.7 |

*In $H_2$ - 22% $CH_4$ - 21% $CO_2$

TABLE IX

| Retention of Ductility Test Results | | | | | | | |
|---|---|---|---|---|---|---|---|
| | | As Heat Treated* Tensile Properties | | | | After Exposure | |
| Alloy No. | Principal Alloying Elements | Yield (Ksi) | Tensile (Ksi) | % Elong | % RA | % Elong | % RA |
| G | (5 Co - 0 Mo) | 58.0 | 114.1 | 55 | 49.7 | 26 | 31.3 |
| 15 | (5 Co - 3 Mo - .09 C) | 44.7 | 97.4 | 62 | 53.0 | 2 | 4.8 |
| 7 | (5 Co - 3 Mo - .15 C) | 52.5 | 107.7 | 57 | 50.4 | 4 | 6.2 |
| 8 | (5 Co - 3 Mo - 2 Al) | 38.9 | 88.5 | 61 | 64.7 | 28 | 27.3 |
| F | (5 Co - 5 Mo) | 50.6 | 100.6 | 57 | 50.4 | 1 | 1.0 |
| 1 | (5 Co - 2 Mo) | 44.4 | 111.4 | 40 | 32.2 | 19 | 18.7 |
| 2 | (5 Co - 2 Mo) | 48.7 | 114.9 | 40 | 37.7 | 19 | 15.8 |
| 4 | (5 Co - 2 Mo) | 38.0 | 98.7 | 59 | 55.5 | 15 | 16.6 |
| 3 | (5 Co - 0 Mo) | 47.9 | 113.0 | 40 | 38.0 | 17 | 16.0 |
| D | (5 Co - 2 Mo) | 31.8 | 90.8 | 54 | 54.3 | 27 | 32.4 |
| C | (5 Co - 2 Mo) | 34.4 | 95.1 | 54 | 57.4 | 30 | 34.2 |
| A | (0 Co - 0 Mo) | 38.5 | 88.8 | 36 | 40.3 | 21 | 30.3 |
| B | (2 Co - 1 Mo) | 35.2 | 92.8 | 59 | 56.2 | 32 | 44.4 |
| 12 | (2 Co - 2 Mo) | 40.2 | 100.2 | 60 | 52.6 | 18 | 19.0 |
| 5 | (0 Co - 3 Mo) | 36.5 | 100.6 | 53 | 53.5 | 12 | 10.0 |

*As heat treated for 4 hrs. at 2250° F.
**Exposed 500 hrs. at 1400° F.

We claim:

1. A highly (i) oxidation and (ii) carburization resistant alloy at temperatures as high as 1800°–2000° F. and further characterized by (iii) good stress-rupture properties at such temperatures while also manifesting (iv) hot and (v) cold workability together with good (v) ductility, (vi) structural stability and (vii) weldability, said alloy in the worked condition having an average grain size of from ASTM 00 to about ASTM 2 and consisting essentially of 32 to 38% nickel, about 15 to less than 19% chromium, about 2 to 4% aluminum, at least 0.07 to 0.15% carbon, from 1.5 to 3.5% molybdenum, about 0.2 to about 0.8% titanium, 0.003 to 0.02% boron, 0.05 to 0.25% zirconium, at least 1 to 5% cobalt and the balance iron.

2. The alloy of claim 1 containing 2.5 to 3.5% aluminum and 2 to 3.5% molybdenum.

3. The alloy of claim 1 containing 0.08 to 0.12% carbon.

4. The alloy of claim 1 in which the sum of the molybdenum plus cobalt does not exceed about 7%.

5. The alloy of claim 1 which has been heat treated within a temperature range of from about 2100° F. (1150° C.) to less then 2400° F. (1316° C.) to develop an average grain size of about ASTM 2 or larger.

6. As a new article of manufacture, tubing for an ethylene pyrolysis environment and formed from the alloy set forth in claim 1.

7. A highly (i) oxidation and (ii) carburization resistant alloy at temperatures as high as 1800°–2000° F. and further characterized by (iii) good stress-rupture properties at such temperatures while also manifesting (iv) hot and (v) cold workability together with good (vi) ductility, (vii) structural and stability (viii) weldability, said alloy in the worked condition having an average grain size of from ASTM 00 to about ASTM 2 and consisting essentially from 30 to 40% nickel, about 15 to 22% chromium, 2 to 4% aluminum, at least 0.05 to 0.3% carbon, from 1 to 4% molybdenum, about 0.2 to about 1% titanium, up to about 0.1% boron, up to 0.5% zirconium, up to 5% cobalt and the balance iron.

8. The alloy of claim 7 which has been heat treated within the temperature range from about 2100° F. (1150° C.) to less than 2400° F. (1316° C.) to develop an average grain size of about ASTM 2 or larger.

9. As a new article of manufacture, tubing for an ethylene pyrolysis environment and formed from the alloy set forth in claim 7.

10. The alloy set forth in claim 7 containing 0.07 to 0.15% carbon, 0.003 to 0.02% boron and 0.05 to 0.25% zirconium.

11. In an ethylene pyrolysis furnace, the improvement in which the furnace tubing is of the alloy set forth in claim 10.

* * * * *